US005478026A

United States Patent [19]

Schönmeier et al.

[11] Patent Number: 5,478,026

[45] Date of Patent: Dec. 26, 1995

[54] WINDING MACHINE WITH SUPPORT CYLINDERS

[75] Inventors: Herbert Schönmeier, Düsseldorf; Peter Hoffmann, Korschenbroich; Hartmut Dropczynski, Dormagen; Reinhard Schönen, Meerbusch, all of Germany

[73] Assignee: Jagenberg Aktiengesellschaft, Dusseldorf, Germany

[21] Appl. No.: 185,787

[22] PCT Filed: Apr. 21, 1993

[86] PCT No.: PCT/EP93/00965

§ 371 Date: Jan. 21, 1994

§ 102(e) Date: Jan. 21, 1994

[87] PCT Pub. No.: WO93/25461

PCT Pub. Date: Dec. 23, 1993

[30] Foreign Application Priority Data

Jun. 15, 1992 [DE] Germany ..... 42 19 541.1

[51] Int. Cl.[6] ..... B65H 35/04

[52] U.S. Cl. ..... 242/527.2; 242/542

[58] Field of Search ..... 242/527.2, 541.1, 242/542, 542.3, 908

[56] References Cited

U.S. PATENT DOCUMENTS

| | | | |
|---|---|---|---|
| 3,497,151 | 2/1970 | Voss et al. | 242/542 X |
| 3,918,654 | 11/1975 | Okubo et al. | 242/542 X |
| 4,183,474 | 1/1980 | Schonmeier | 242/542 X |
| 4,368,855 | 1/1983 | Schonmeier et al. | 242/542 X |
| 4,370,193 | 1/1983 | Knauthe | 242/527.2 |
| 4,635,867 | 1/1987 | Kytonen | 242/542 X |
| 5,067,663 | 11/1991 | Dropczynski | 242/527.2 |
| 5,310,130 | 5/1994 | Wieland et al. | 242/542 X |

FOREIGN PATENT DOCUMENTS

| | | |
|---|---|---|
| 2920707 | 12/1980 | Germany . |
| 9110490 U | 10/1991 | Germany . |
| 9112927 U | 12/1991 | Germany . |
| 2070495 | 9/1981 | United Kingdom . |
| WO92/03366 | 3/1992 | WIPO . |

*Primary Examiner*—John M. Jillions
*Assistant Examiner*—William A. Rivera
*Attorney, Agent, or Firm*—Herbert Dubno

[57] ABSTRACT

For winding webs of material on cores winding machines have two support rollers on which the winding rolls are supported during winding. The web is guided from underneath through the gap between the support cylinders. When the winding rolls are exchanged, for the cutting of the web a cutting knife with a tear-off blade is raised through the gap between the support cylinders up to the cylinder bed. In order to reduce the bearing load of the winding rolls on the support cylinders in the lower wedge between the two support cylinders an air box extending over the work width and having a compressed air supply line is provided, which seals the gap between the support cylinders and has an air exit slot open towards this gap. The tear-off blade of the cutting knife is attached to a support arranged in the air box and can be moved up and down through the air exit slot into the cutting position in the cylinder bed and completely lowered into the air box.

7 Claims, 3 Drawing Sheets

WINDING MACHINE WITH SUPPORT CYLINDERS

CROSS REFERENCE TO RELATED APPLICATIONS

This application is a national phase of PCT/EP93/00965 filed 21 Apr. 1993 and based, in turn, on German national application P 42 19 541.1 of 15 Jun. 1992 under the International Convention.

FIELD OF THE INVENTION

Our present invention relates to a winding machine with support cylinders for winding webs of material, particularly paper or cardboard webs on cores. Such winding machines serve for the manufacture of wound rolls from webs of material subdivided through longitudinal sectioning. During winding the winding rolls are supported in axial, alignment on the two support cylinders.

BACKGROUND OF THE INVENTION

In order to keep the standstill times of a winding machine as short as possible during the exchange of the winding rolls, it is known from DE-OS 2920707 to cut the web of material in the cylinder bed formed by the support cylinders by means of a sectioning device having a tear-off blade, which can be raised through the gap between the cylinders, at the moment when the fully wound roll is pushed off. The new web end created by the cut is kept by underpressure (suction) on the wrapped support cylinder, until a new set of cores is introduced onto the cylinder bed, i.e. the gap formed between the support cylinders.

From WO 92/03366 a winding machine with support cylinders is known, wherein superatmospheric pressure is created with compressed air in the space defined by the support cylinders and the winding rolls. This superatmospheric pressure reduces the bearing load and thereby also the line load (=bearing load per width of a winding roller) at the two contact lines of each wound roll on the support cylinders, which has a significant influence on the winding firmness of the winding roll. Because of this load reduction, it is possible to wind winding rolls with very large diameters (more than 800 mm) with very good winding quality.

According to one embodiment, in the area of the lower wedge between the support cylinders an air box is provided. The air box extends over the entire work width (=axial length of the support cylinders) and is provided with a supply line for compressed air. The air box is swingable from an upper work position, wherein its lateral surfaces are pressed sealingly against the support cylinders to a position underneath one support cylinder. The lowering makes room for a separate cutting knife which can be raised from below through the gap between the support cylinders and whose tear-off blade tears off the web when the fully wound roller is pushed out.

OBJECT OF THE INVENTION

It is the object of the invention to provide an improved winding machine with support cylinders, so that it has a compact construction and is possible to perform the roll replacement in a shorter time.

SUMMARY OF THE INVENTION

This object is achieved in a winding machine with support cylinders for winding a web of material, particularly a paper or cardboard web, onto cores with two support cylinders on which the winding rolls are supported during winding, whereby the web of material partially looped around a support cylinder is guided from underneath through the gap between the support cylinders. A cutting knife for sectioning the web when the winding rolls are replaced has a tear-off blade which can be lifted through the gap between the support cylinders until it reaches the cylinder bed. An air box extends over the working width and has a compressed air supply line and is arranged in the lower wedge between the support cylinder to seal the gap between the support cylinders, being provided with an air exit slot extending over the work width.

According to the invention the tear-off blade of the cutting knife is fastened to a support which can move up and down in the air box and can be raised through the air exit slot until it reaches its cutting position in the cylinder bed and can be completely lowered into the air box.

The arrangement of the cutting knife support with the tear-off blade in the air box requires less space than a separate cutting knife. Furthermore, the air box does not have to be lowered in order to replace the rolls. Its lowering is required only when a new web is inserted or in case of a paper jam. The roll exchange can be done quickly, because the tear-off blade can be raised to its cutting position in the cylinder bed, without having first to swing away the air box.

The arrangement of the cutting knife support with the tear-off blade in the air box requires less space than a separate cutting knife. Furthermore, the air box does not have to be lowered in order to replace the rolls. Its lowering is required only when a new web is inserted or in case of a paper jam. The roll exchange can be done quickly, because the tear-off blade can be raised to its cutting position in the cylinder bed, without having first to swing away the air box.

The tear-off blade can be fastened to a holder which is supported on the support so that it can be swung towards the wrapped cylinder.

The holder of the tear-off blade can be a two-part lever, whose side turned away from the tear-off blade is connected with a piston-cylinder unit fastened to the lower part of the support.

The piston-cylinder unit can be linked to a lever which is articulately mounted to the holder, whereby its link point is slightly offset in the direction of the support cylinder which is not looped by the web, when the piston rods are retracted.

On the end of the holder facing away from the tear-off blade, freely rotatable wheels are mounted and in the upper part of the air box vertical guides for the wheels are arranged.

In the air box a piston-cylinder unit is mounted for the up and down movements of the support, whereby at least its piston rod is located inside the air box.

BRIEF DESCRIPTION OF THE DRAWING

The drawing serves for the clarification of the invention with respect to an embodiment of the winding machine. In the drawing.

SPECIFIC DESCRIPTION

Figure 1:
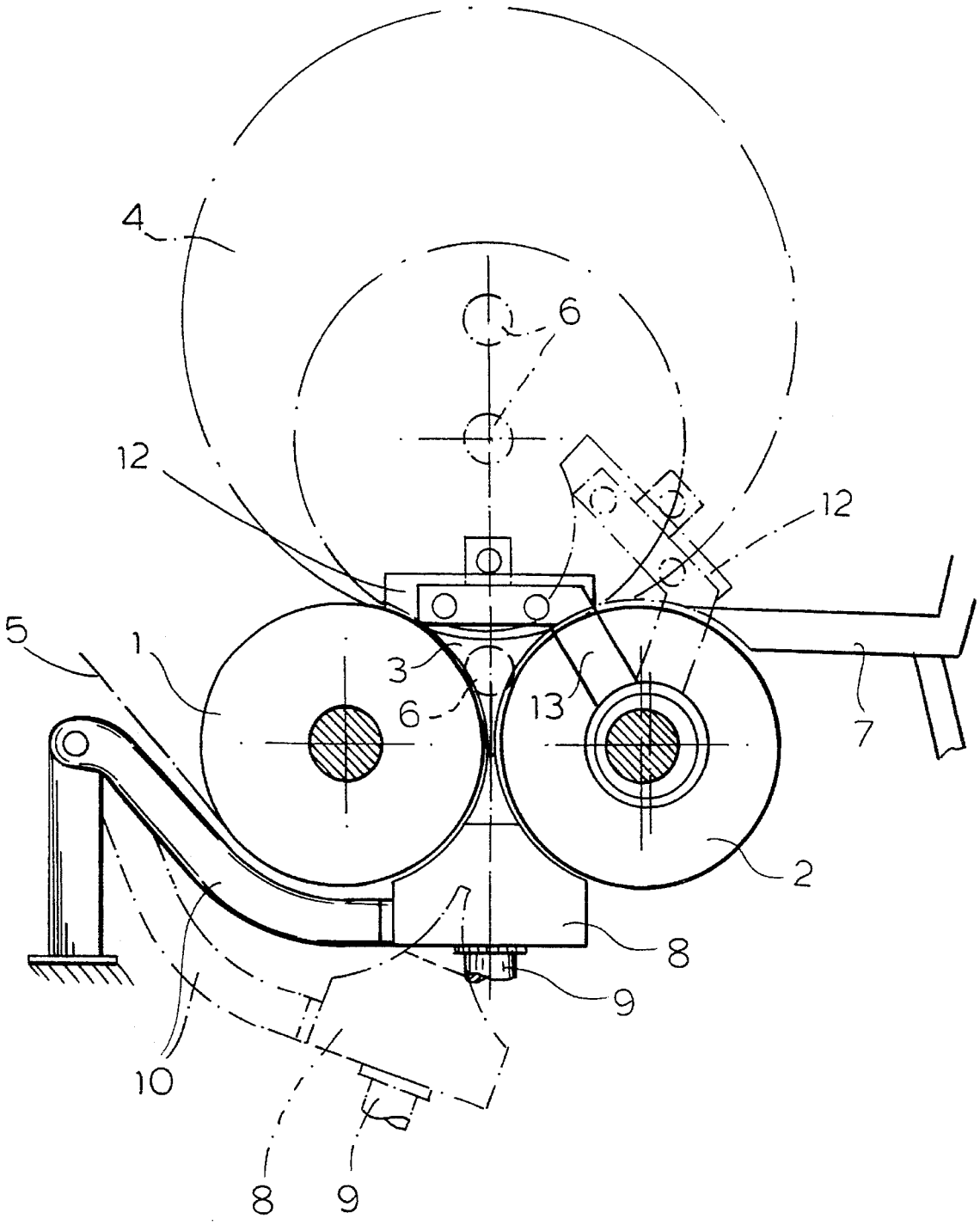
FIG. 1 is a schematic lateral view in section of a winding machine with support cylinders.

The winding machine with support cylinders has two driven support cylinders 1, 2, between which a cylinder bed is created. In the cylinder bed the winding rolls 4 rest on the support cylinders 1, 2 during winding. The web of material 5, preferably a paper or cardboard web, longitudinally subdivided in individual webs is guided by support cylinder 1 and directed from underneath through the gap between support cylinders 1, 2 into the support cylinder bed 3 and there wound onto cores 6 aligned in a row. The finished wound rolls 4 are pressed by an ejection bar not shown in the drawing over the support cylinder 2 onto a lowering platform 7, from where the wound rolls 4 are lowered for discharge.

In order to reduce the bearing load of the winding rolls 4 on the support cylinders 1, 2, in the space defined by the support cylinders 1, 2 and the winding cores 6, (i.e. in the upper wedge-shaped gap 0) overpressure can be created with compressed air. For this purpose in the lower wedge between the two support cylinders 1, 2 an air box 8 with a supply line 9 for compressed air is provided, which extends over the axial length of the support cylinders 1, 2 and whose lateral surfaces facing the support cylinders 1, 2 are curved in their upper portion to fit the peripheral surfaces of the support cylinders 1, 2, so that they can snugly seal them.

In the curved lateral surfaces, several axially extending felt strips are laid on the outside, which at minimal friction seal the air box 8 with regard to the support cylinders 1, 2. The air box 8 is mounted on pivot arms 10 which are supported in the machine stand. In this way the air box 8 can be lowered from its upper sealing position until it reaches a rest position shown in FIG. 1 in dash-dot lines, e.g. in order to introduce a new web 5. In its upper sealing position, its upper portion of the air box reaches up to the narrowest area between the two support cylinders 1, 2. The upper limiting surface facing the support cylinder gap has an air exit slot 11 extending at least over the minimal web width and is designed on both sides of the machine to serve as guide surfaces for two frontal sealing elements 12 arranged on both sides of the machine.

The shape of the frontal sealing elements 12 is fitted to the shape of the free cross section surface between the support cylinders 1, 2, whereby its upper portion is rectangularly extended beyond the connection line between the two apexes of the support cylinders 1, 2, so that in the case of winding rolls 4 with large diameter a sufficient sealing surface is insured. The sealing elements 12 are movable in axial direction—i.e. transversely to web 5—fastened slidably to lateral pivot arms 13, whose pivot axis runs slightly eccentrically and outwardly offset on the connection line between the two support cylinders. In way the sealing elements 12 can be swung out of the cylinder bed 3, over the support cylinder 2 into a position in which it is possible to introduce lateral guide heads into the cores 6. The very slight eccentricity leads to the fact that the lateral surfaces of the sealing elements 12 facing the support cylinders 1, 2, when swung outwardly, move away slightly from the respective support cylinder surface, e.g. making possible the removal of paper scraps.

Figure 2:
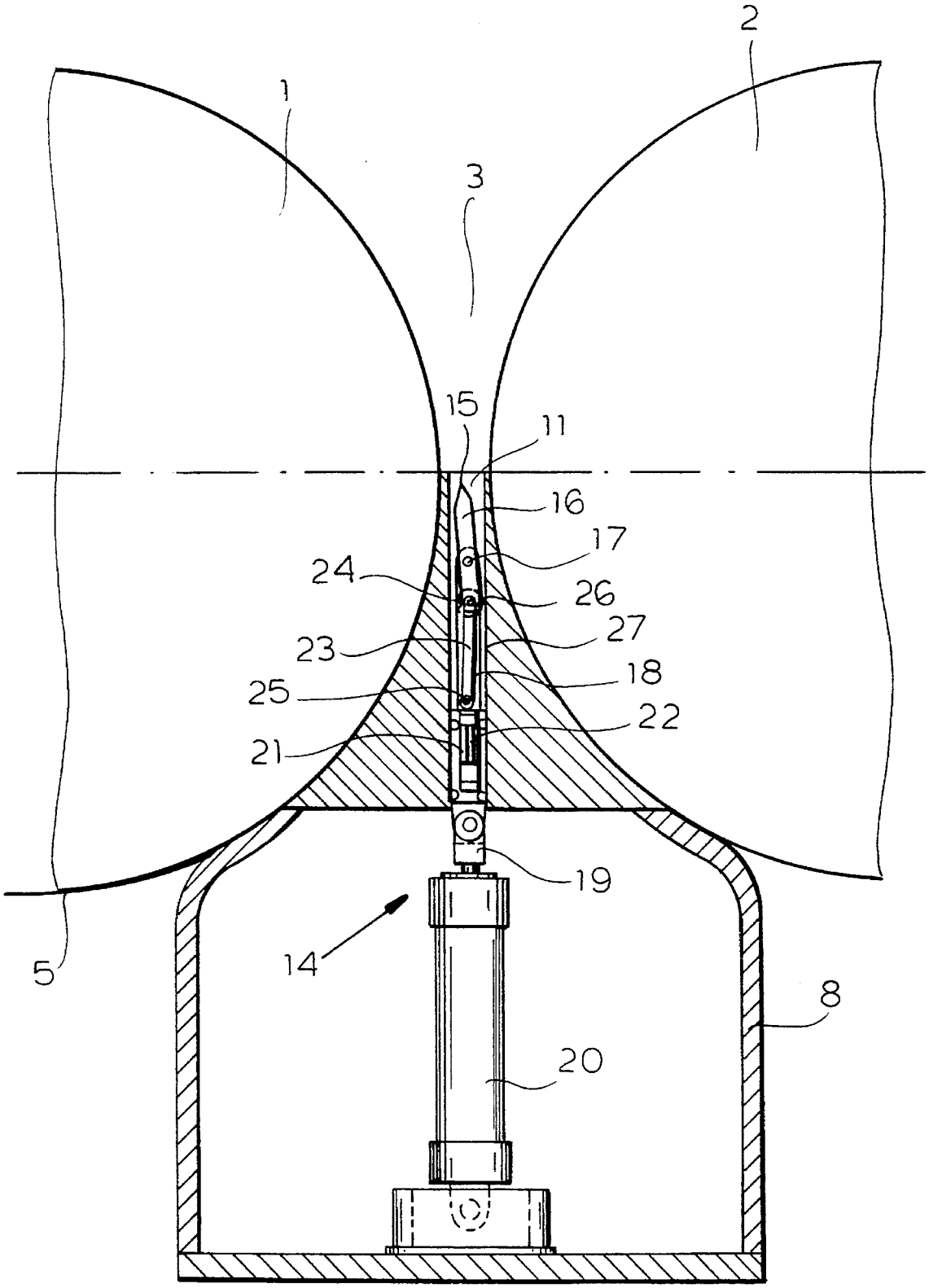
FIG. 2 is an enlarged representation in cross section through the air box with the cutting knife in rest position.

In the air box 8 a cutting knife 14 with a tear-off blade 15 is arranged, which in the sealing position of the air box 8 moves upwardly reaching the cylinder bed 3 and which can be lowered into the air box 8. In FIG. 2 the tear-off blade 15 is lowered, in FIG. 3 it is in its cutting position in the cylinder bed 3.

The tear-off blade 15 extends over the entire length of the feeding slot, i.e. basically over the entire machine width. It is fastened to the end of a holder 16 also extending over the machine width and having the shape of a two-part lever, which is linked approximately centrally to the end of a vertical support 18 and is rotatable about an axis 17 parallel to the axes of the support cylinders.

The support 18 is fastened to the end of piston rods 19 of vertical, hydraulic piston-cylinder units, whose cylinders 20 are bolted tightly to the bottom of the air box 8 and are supported by it. To the lower end of the support 18, the cylinders 21 of pneumatic piston-cylinder units whose piston rods 22 extend vertically upwards, are fastened. The end of piston rods 22 are articulately connected with the holder via lever 23 in such a manner that the linkage points 24 with the holder 16, when the piston rods 22 are completely retracted, are slightly offset in the direction of the support cylinder 2 with respect to the linkage points 25 with the piston rods 22.

Figure 3:
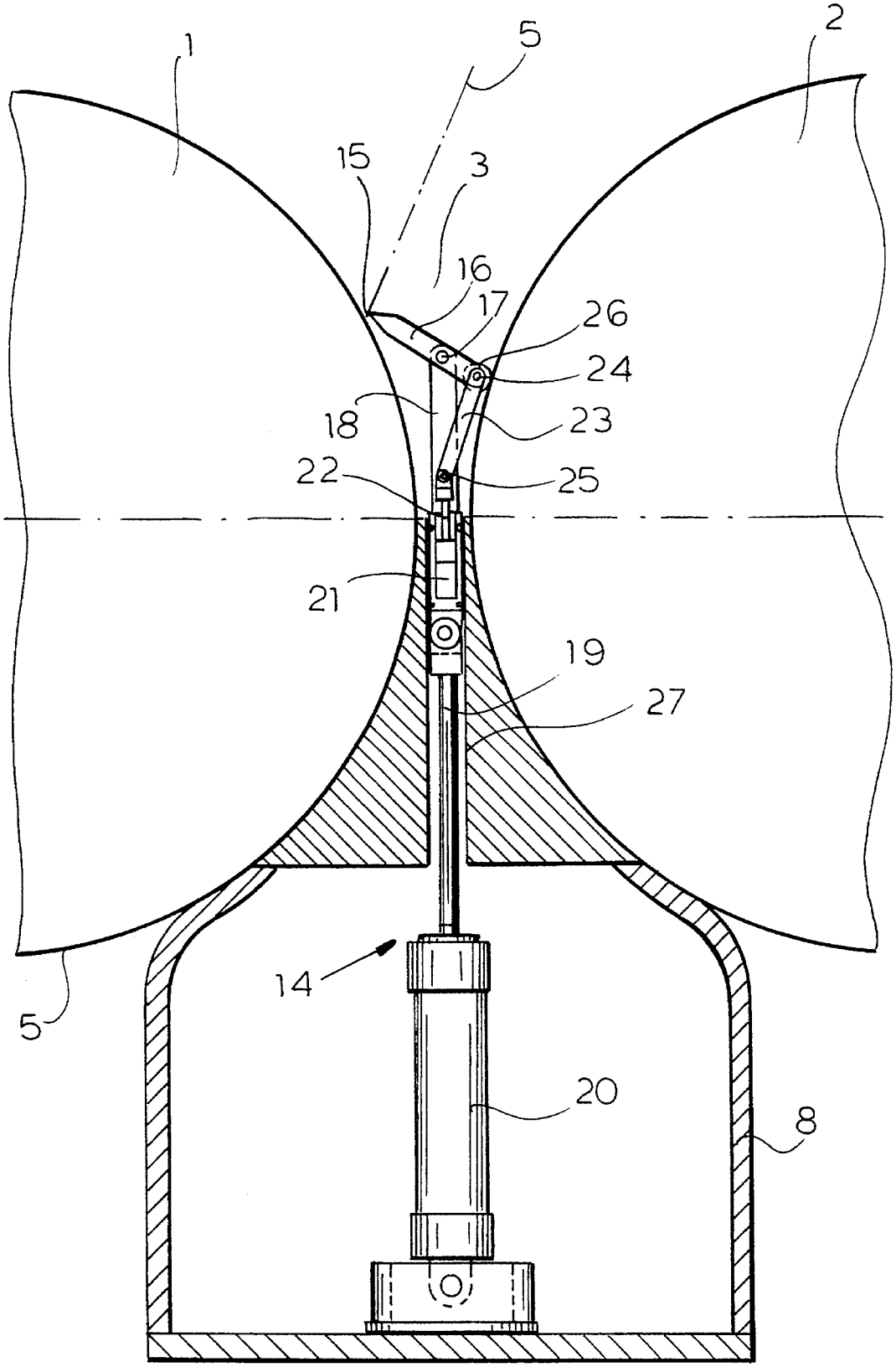
FIG. 3 is a cross section wherein the tear-off blade of the cutting knife is in the sectioning position.

The tear-off blade 15 is moved in the direction of the support cylinder 1 when the piston rods 22 are extended, as shown in FIG. 3. In order to be able to stretch the holder 16 and the lever 23, the support 18 has in its upper part recesses for receiving the same. The end of lever 23 facing away from the tear-off blade 15 consists of separate straps arranged at a distance from each other, whereby on the end of each strap alternately either one of the levers 23 is linked or a freely rotatable wheel 26 is supported. The axis of rotation of the freely rotatable wheels 26 runs coaxially with the link points 24. There are also recesses provided in the upper part of support 18 for these wheels 26 axially offset in the direction of the levers 23, wherein they can move.

The lower part of the support 18 with the piston cylinder units 21, 22 is guided along vertical guides 27, which are arranged in the upper part of the air box 8. On the side towards support cylinder 2, offset in axial direction with respect to the guides 27, further vertical guide rails for the wheels 26 are fastened to the upper part of air box 8, these determining the tilted position of the holder 16, while the wheels 26 are still in the air box. As soon as the wheels 26 leave the air box 8 travelling upwards, they are guided by the support cylinder 2, this way establishing the tilting position of holder 16 with the tear-off blade 15.

In the embodiment described the entire cutting knife with its lifting mechanism is arranged in the air box 8. It is also possible to fasten the cylinder 20 of the piston-cylinder unit 19, 20 outside on the bottom of the air box 8 and to guide the piston rod 19 sealed through the bottom of the air box 8. This has the advantage that the supply lines for the piston-cylinder unit 19, 20 can be arranged outside the air box 8. If for the stability of the air box 8 it is necessary to arrange transverse partitions, the cutting knife 14 can be subdivided into separate segments (e.g. four in a work width of 8 m), which are arranged successively in axial direction. Then each of these segments consists of parts extending over the width of the segment (tear-off blade 15, holder 16, support 18), which are each moved up and down by two lateral piston-cylinder units 19, 20 and wherein the tilting motion of the tear-off blade 15 is performed by two lateral piston-cylinder units 21, 22 fastened to the lower part of the support 8.

As soon as the bearing load of the winding rolls 4 exceeds a certain value during winding, the frontal sealing elements 12 are swung into the cylinder bed 3 and moved axially against the frontal sides of winding rolls 4. The air box 8 is swung upwards, so that the lower wedge between the support cylinders 1, 2 is sealed off and the sealing elements 12 can come to rest on its upper limiting surface. The elements 12 seal off the air exit slot 11 outside of the winding roll area. By introducing compressed air into the air box 8, under the winding rolls 4 a superatmospheric pressure is created, which reduces the bearing load to the desired value. The compressed air leaves through the air exit slot 11, while all parts of the cutting knife 14, including the tear-off blade 15, are lowered in the air box 8. This position is shown in FIG. 2.

After the winding operation is concluded, the compressed air is turned off, the frontal sealing elements 12 are swung out of the cylinder bed 3 and the tear-off blade 15 of the cutting knife 14 is moved into cutting position, as shown in FIG. 3. For this purpose first compressed air is introduced into the cylinders 21, this prestressing the pistons 22. A tilting motion of the holder 16 is not possible yet, because a lateral movement of the wheels 26 in the direction of support cylinder 2 is prevented by the guide rails. Subsequently the piston-cylinder units 19, 20 move the tear-off blade 15 upwards. As soon as the wheels 26 have left the upper part of air box 8, they are deflected against the support cylinder 2. Thus, during the upward motion of the tear-off blade 15 a tilting motion in the direction of support cylinder 1 takes place, without the need to guide the piston-cylinder units 21, 22.

The height of support 18, the width of holder 16 and the stroke of piston 22 are selected so that when the piston rods 19 move upwards, the tear-off blade 15 positions itself exactly in its cutting position in the cylinder bed 3, at a short distance from the web-looped support cylinder 1. Subsequently the fully wound rolls 4 are pushed off over the support cylinder 2 which is not looped, and thereby the web 5 is torn by the tear-off blade 15. The so-created new web beginning is held on support cylinder 1, e.g. by suction. Subsequently the tear-off blade 15 is again lowered into the air box 8. For this purpose, first the tear-off blade 15 with the piston-cylinder units 19, 20 is set in an approximately vertical position, after that the piston-cylinder units 19, 20 move the support 18 with all its mounted parts downwards, until the tear-off blade 15 is in the air box 8. After a set of new winding cores 6 have been inserted in the cylinder bed 3 and the new web beginnings have been fastened thereto, the support cylinders 1, 2 are again set in rotation and the winding operation is restarted.

We claim:

1. A winding machine, comprising:

two support cylinders extending over a width of the machine and defining an upwardly widening upper wedge-section gap opening upwardly at a bed formed by said cylinders and on which a roll wound from a web of material rests, said web being partially looped about one of said support cylinders, said support cylinders further defining an upwardly converging lower wedge-section gap communicating with said upper gap;

an air box received in said lower wedge-section gap and having flanks sealingly engaging said support cylinders, said air box having a chamber, a compressed air supply line connected to said chamber for supplying compressed air thereto, and an upwardly open air exit slot extending over said machine width for pressurizing said upper gap and relieving force with which said roll rests on said cylinders;

a tear-off blade received in said air box and raisable through said slot out of said air box into a cutting position at said cylinder bed for cutting said web upon completion of said roll, thereby allowing removal of said roll from said bed, said blade being fully retractable into said air box through said slot;

a support in said air box carrying said blade and raisable and lowerable in said air box; and actuating means in said air box operatively connected to said support for selectively displacing said support to retract said blade and displace said blade into said cutting position.

2. The winding machine defined in claim 1, further comprising a holder articulated to said blade and to said support for canting said blade toward said one of said cylinders upon raising of said blade from said air box through said slot.

3. The winding machine defined in claim 2 wherein said holder is a two-part lever having a side turned away from said blade formed with a piston-and-cylinder unit fastened to said support.

4. The winding machine defined in claim 3 wherein said piston-and-cylinder unit is linked to a lever articulated to said holder at a link point slightly offset toward the other of said cylinders upon retraction of said unit.

5. The winding machine defined in claim 2, further comprising a wheel mounted freely rotatably on an end of said holder opposite said blade.

6. The winding machine defined in claim 5, further comprising a guide formed in said air box for said wheel.

7. The winding machine defined in claim 1 wherein said actuating means is a piston-and-cylinder unit having at least a piston rod located inside said air box.

* * * * *